US005520147A

United States Patent [19]

Secord

[11] Patent Number: 5,520,147

[45] Date of Patent: May 28, 1996

[54] ROTARY MOTOR OR ENGINE HAVING A ROTATIONAL GATE VALVE

[76] Inventor: Denver Secord, Rte. 2, Oliver, B.C., Canada, V0H 1T0

[21] Appl. No.: 530,664

[22] Filed: Sep. 20, 1995

[51] Int. Cl.[6] ..... F02B 53/00

[52] U.S. Cl. ..... 123/249; 123/210; 418/188

[58] Field of Search ..... 123/249, 210; 418/185, 188

[56] References Cited

U.S. PATENT DOCUMENTS

| | | | |
|---|---|---|---|
| 808,255 | 12/1905 | Philippon | 418/207 |
| 1,874,247 | 8/1932 | Dalton | 418/245 |
| 1,949,723 | 3/1934 | Kotelevtseff | 418/227 |
| 2,182,719 | 12/1939 | Booth | 418/227 |
| 3,640,252 | 2/1972 | Spinnett | 418/196 |
| 4,144,004 | 3/1979 | Edwards | 418/185 |
| 4,202,315 | 5/1980 | Lutrat | 123/249 |
| 5,350,287 | 9/1994 | Secord | 418/245 |

FOREIGN PATENT DOCUMENTS 2233713 1/1991 United Kingdom .

*Primary Examiner*—Charles Freay

*Attorney, Agent, or Firm*—Wells, St. John, Roberts, Gregory & Matkin

[57] ABSTRACT

An engine block mounts one or more rotors 16 within cylindrical rotor bores that are partially overlapped by cylindrical gate valve bores. A rotary gate valve is mounted within the gate valve bore and partially overlaps the rotating rotor. Angularly spaced lobes on the rotor are interspersed with angularly spaced flanges on the rotary gate valve. The lobes rotate within a groove that is closed off by movement of the flanges, thereby forming an expandable "combustion chamber" to propel the rotor about its axis. Incoming gases can be provided through and combusted within hollow portions of the rotor.

11 Claims, 7 Drawing Sheets

ROTARY MOTOR OR ENGINE HAVING A ROTATIONAL GATE VALVE

TECHNICAL FIELD

The present invention relates to rotary motors and engines that use a movable gate valve to define an expansion chamber for a rotor. More particularly, it relates to improvements in the gate valves of such engines.

BACKGROUND OF THE INVENTION

Reciprocating motors and engines have the notorious disadvantage of inefficiency due to the energy wasted in reversing the direction of motion of one or more reciprocating pistons. This problem has been addressed by inventors of various forms of rotary engines using movable gate valves that define expansion chambers for a rotor. One solution is described in my U.S. Pat. No. 5,350,287, issued on Sep. 27, 1994, which is hereby incorporated into this disclosure by reference.

A rotary motor or engine with continuous unidirectional rotational rotor motion has a distinct advantage over reciprocating engines in that there is no energy wasted in changing piston direction. Such motors and engines have a drawback, however, in the difficulties that have been encountered in providing a relatively stationary surface against which expanding fluids in the firing or expansion chamber can react to drive the rotor about its rotational path. The reaction surface must be movably positioned to intersect the rotational path of a projecting lobe or land on a rotor that serves as a rotary "piston". The problem then becomes how to efficiently move the reaction surface from the path to allow passage of the "piston".

This problem is eliminated by the "Wankel" form of engine, which uses a combination of the rotor and engine block as the reaction surface. However, the bore surfaces of the engine block are nearly tangential to the piston surfaces, so the reaction forces are not ideally suited to produce maximum torque for the rotor. Even so, the "Wankel" form of engine clearly shows advantages over the reciprocating engine forms.

The present invention has for its primary objective, provision of a rotary motor or engine in which expansion forces are substantially concentrated to produce torque. All moving elements rotate continuously, thereby eliminating the need for reciprocation of the controlling valve structure.

BRIEF DESCRIPTION OF THE DRAWINGS

A preferred embodiment of the invention is described below with reference to the accompanying drawings, which are briefly described below.

FIG. 6 is a view similar to FIG. 5, adding the included rotors and gate valves;

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

As used herein, the term "engine" shall include internal and external combustion engines, as well as motors operated by externally pressurized fluids, whether gaseous or liquid.

Figure 4:
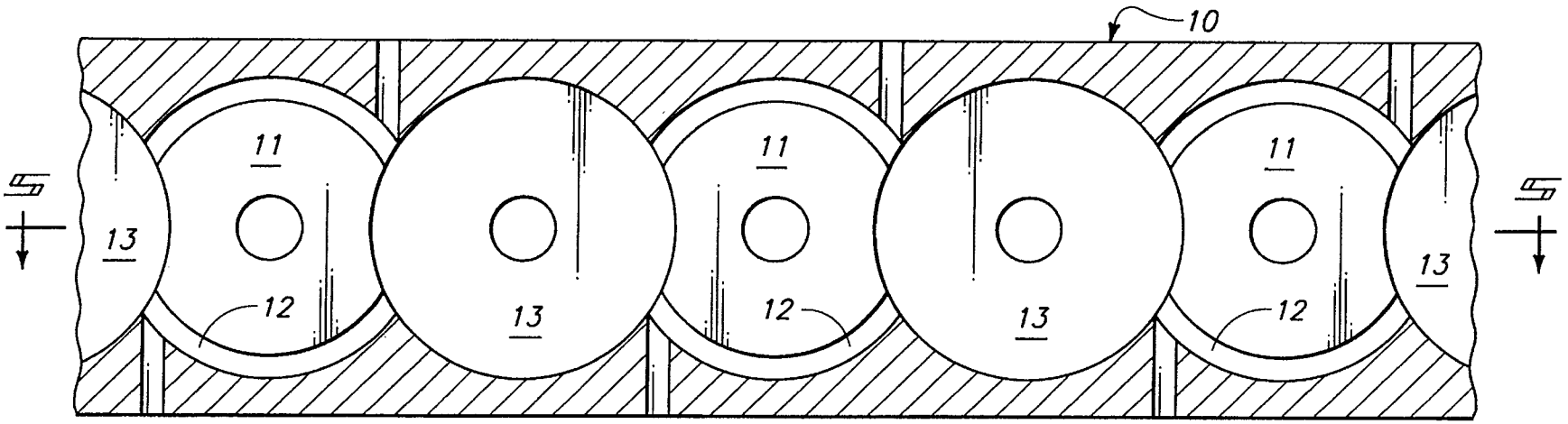
FIG. 4 is a sectional view through the housing as seen along line 2—2 in FIG. 1.
Figure 5:
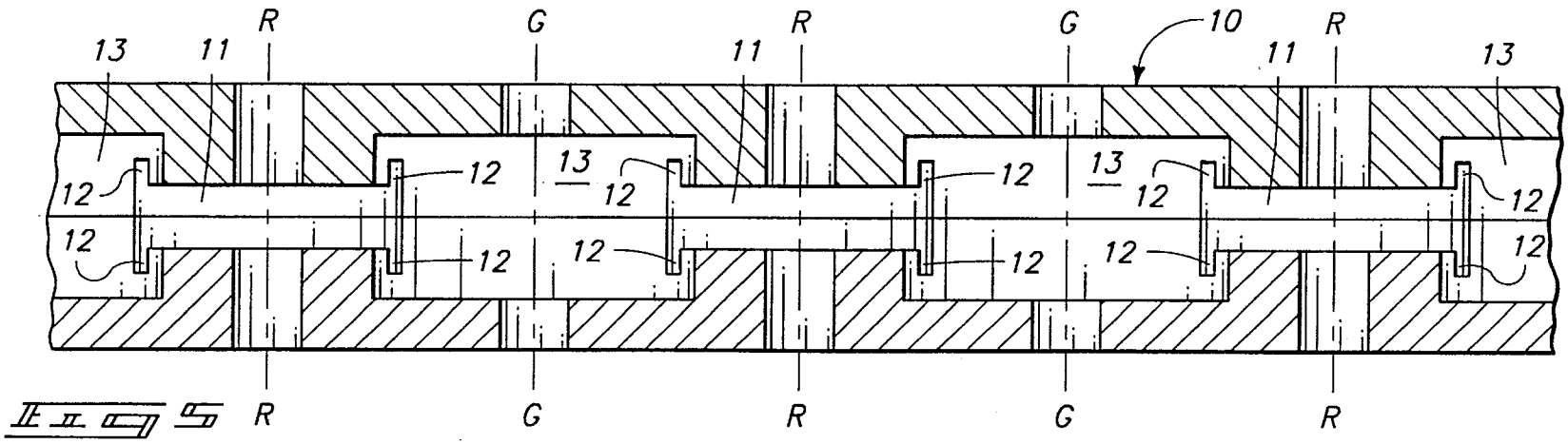
FIG. 5 is a sectional view through the assembled housing (minus rotors and valves) as taken along line 5—5 in FIG. 4.
Figure 5:
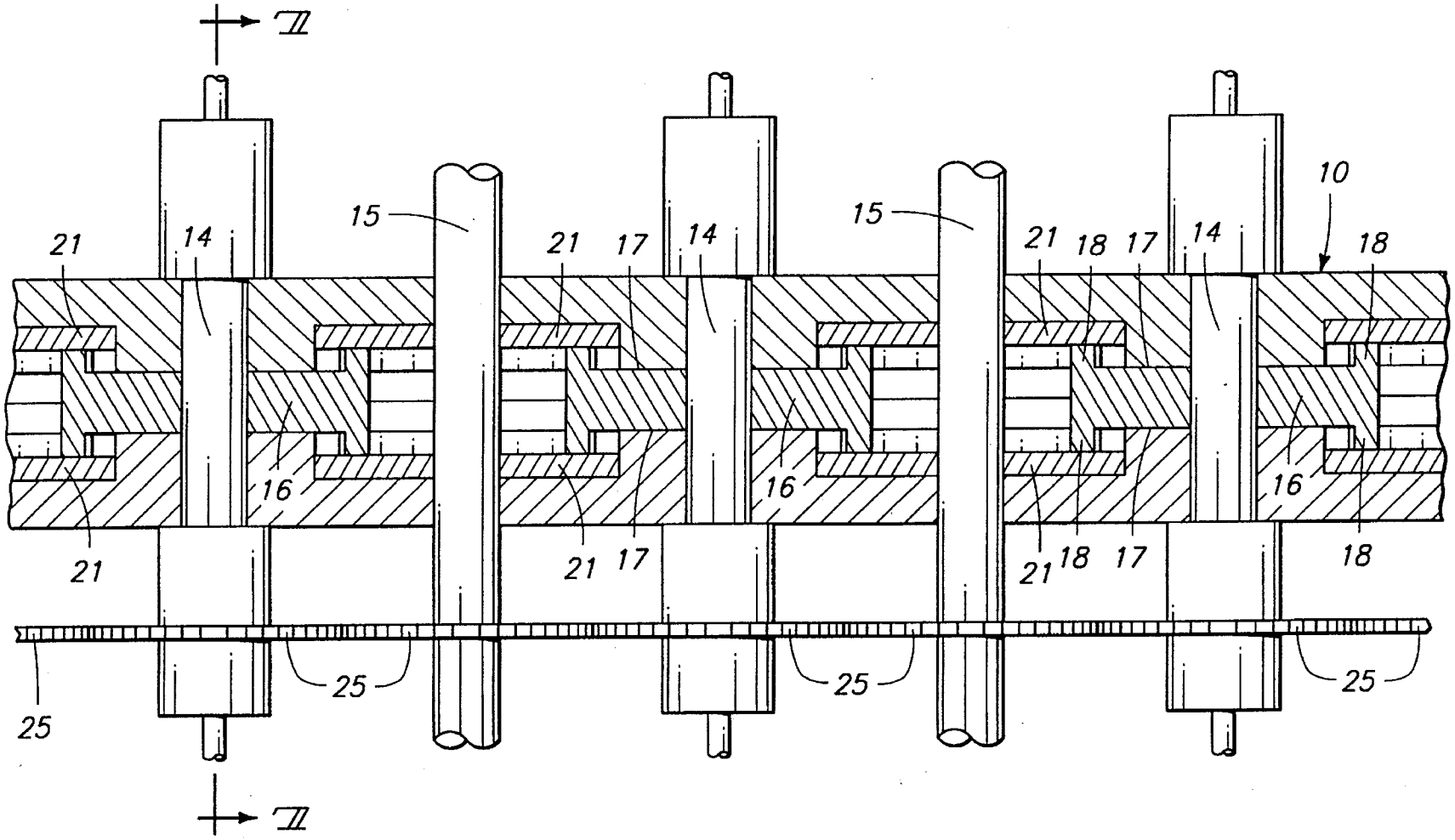

The engine schematically illustrated in the drawing figures includes an engine block 10 formed in two mirror image halves that are joined along the transverse center of the resulting engine. Details of the engine block are schematically shown in FIGS. 4 and 5. It might be formed as a machined metal casting from materials such as aluminum, iron, or other rigid materials having appropriate casting, machining, wear and heat transfer characteristics.

The engine schematically shown in FIGS. 1–6 includes three rotor bores 11 that are partially overlapped by four gate valve bores 13. Any desired number of rotor and gate valve bores can be used in a specific engine design according to this disclosure. Since the multiple bores are identical, the following basic description of the engine and its operation will focus on details of the central rotor and one adjacent gate valve. The multiple possibilities for engine design presented by this arrangement will become evident.

Each cylindrical rotor bore 11 is centered about a transverse rotor axis R—R (see FIG. 5). A coaxial rotor shaft 14 is mounted within the engine block 10 for rotation about the rotor axis R—R. The individual rotor bores each also include a coaxial annular open groove 12 formed within the rotor bore, preferably about its circular periphery.

A cylindrical rotor 16 is located within the rotor bore 11. It is coaxially fixed to the rotor shaft 14. Rotor 16 includes first and second sides 17 facing oppositely to one another. Sides 17 are perpendicular to and spaced along the rotor axis R—R. The illustrated sides 17 of rotor 16 are shown as being solid, but could be spoked or partially open to reduce overall rotor weight.

The rotor 16 also includes two lobes 18 protruding axially from at least one of its sides 17. In the illustrated form of the engine, two lobes 18 are diametrically spaced across the rotor axis R—R at each of its sides 17. Each lobe has a rearward wall 20 that is transversely complementary to and positioned within a groove 12 for rotational movement along a path centered about the rotor axis R—R.

Each cylindrical gate valve bore 13 partially overlaps and interrupts an adjacent rotor bore 11. Each gate valve bore 13 is centered about a transverse gate valve axis G—G that is parallel to the rotor axis R—R previously identified.

A gate valve shaft 15 is mounted within the engine block 10 for rotation about gate valve axis G—G. A surrounding rotary gate valve 21 is fixed to each shaft 15 for rotation about axis G—G. The rotary gate valve includes first and second oppositely facing sides 22 along the gate valve axis G—G. The illustrated rotary gate valves 21 have a spoked configuration that reduces their mass and weight.

The rotary gate valve 21 is provided with flanges 23 protruding axially from one of its sides in opposition to a lobe 18 of the rotor 16. In the illustrated arrangement, each rotary gate valve 21 has two annularly spaced flanges 23 directed toward one side of an overlapped rotor 16. Flanges 23 protrude in a direction opposite to the protruding lobes on the overlapped side of the rotor 16. The axial dimensions of the oppositely protruding lobes 18 and flanges 23 along their respective axes R—R and G—G are substantially identical.

In the preferred configuration as illustrated, the two lobes at each side of the rotors and two flanges at each side of the gate valves are diametrically in opposition. This balances the operational forces on both the rotors and the gate valves in a radial dimension. At the same time, the rotors and flanges at the two axial sides of the elements balance forces along the supporting shafts in an axial dimension. The result is a combination of balanced forces that minimize bearing loads for the machinery.

The rotary gate valve 21 partially overlaps the rotational path of a rotor 16 for rotation of its flanges 23 about a circular path that periodically intersects and closes off groove 12 during each revolution of the rotor 16 and rotary gate valve 21 about their respective rotational axes. This timed rotational movement of each rotor 16 and rotary gate valve 21 thereby defines an expansion chamber having a volume that increases as a function of rotor movement. It can serve as an engine expansion or combustion chamber extending angularly about a groove 12 from each flange 23 to the rearward wall 20 of a moving lobe 18.

Figure 1:
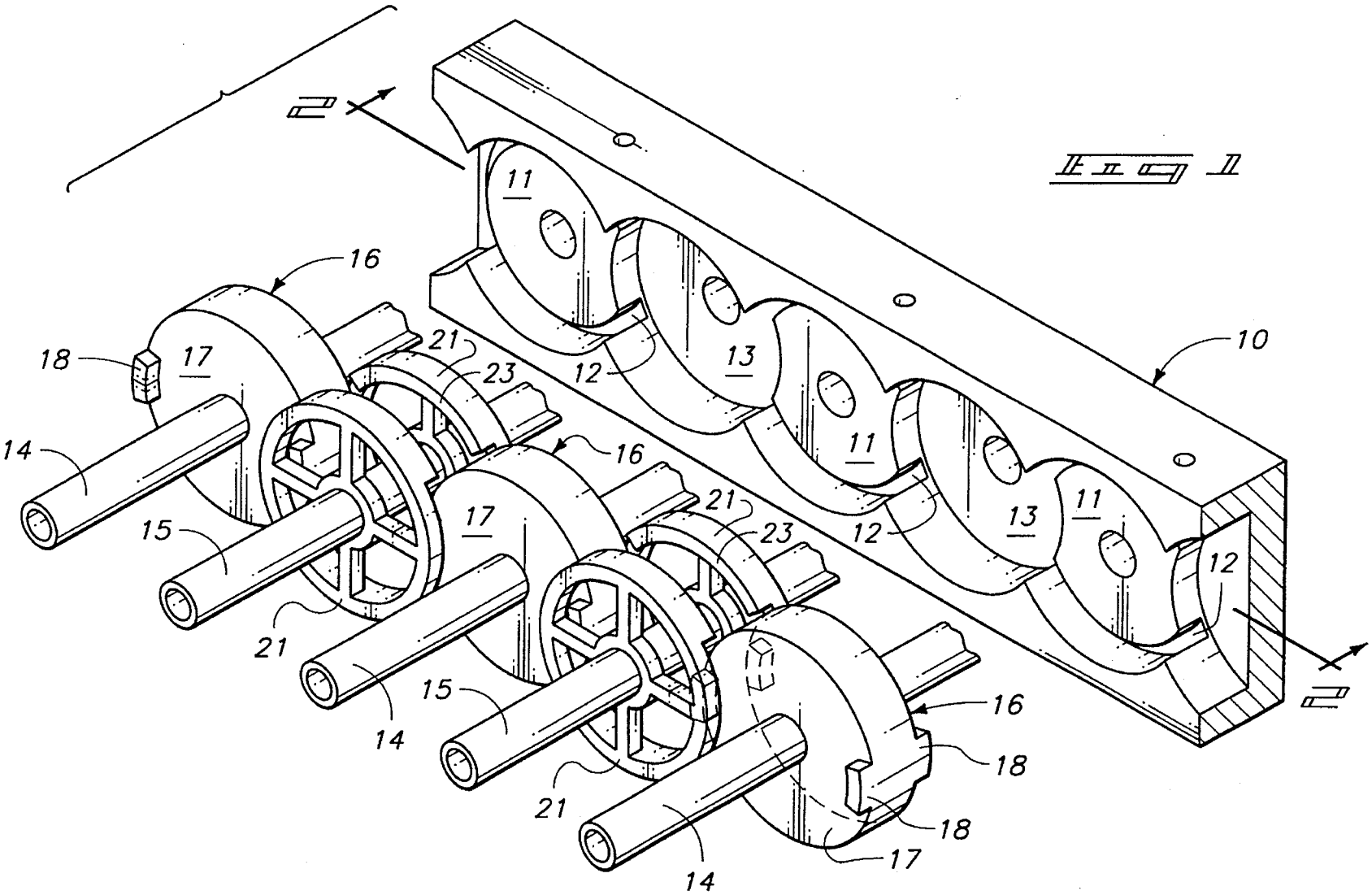
FIG. 1 is a fragmentary exploded view that schematically illustrates the relationship between one half of an engine housing and the rotors and gate valves mounted within it.
Figure 2:
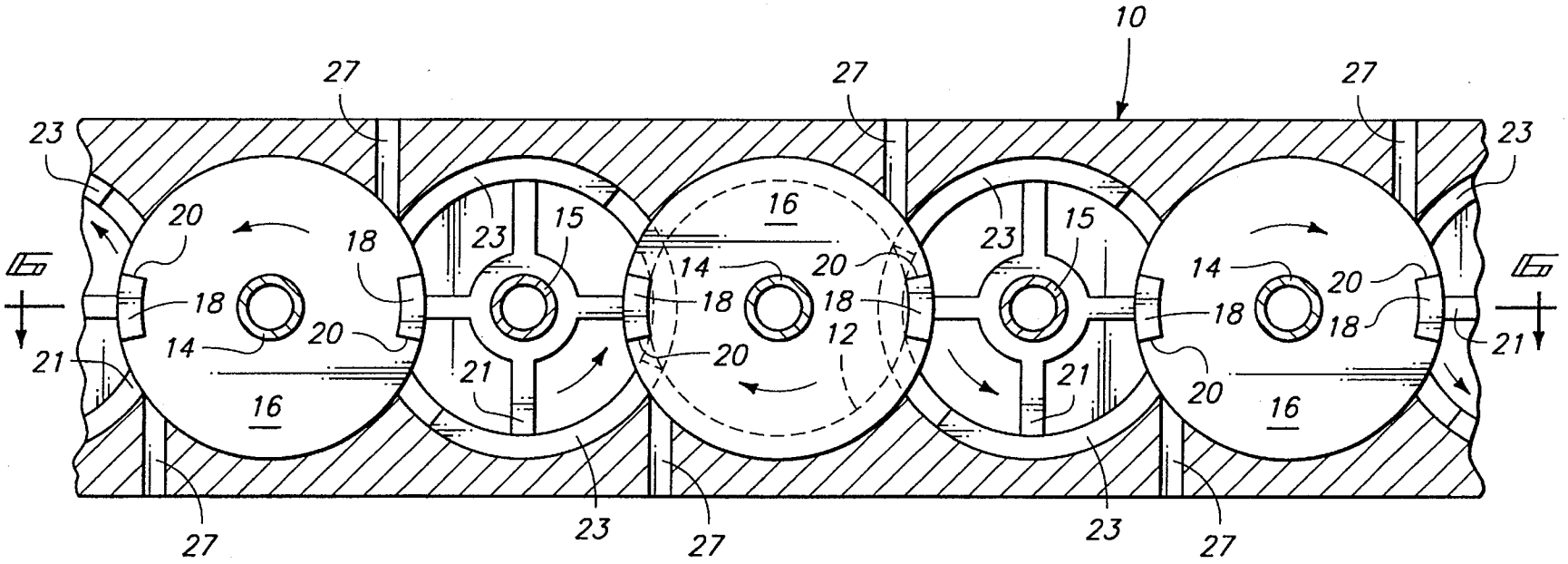
FIG. 2 is a sectional view of the assembled engine as seen along line 2—2 in FIG. 1.
Figure 3:
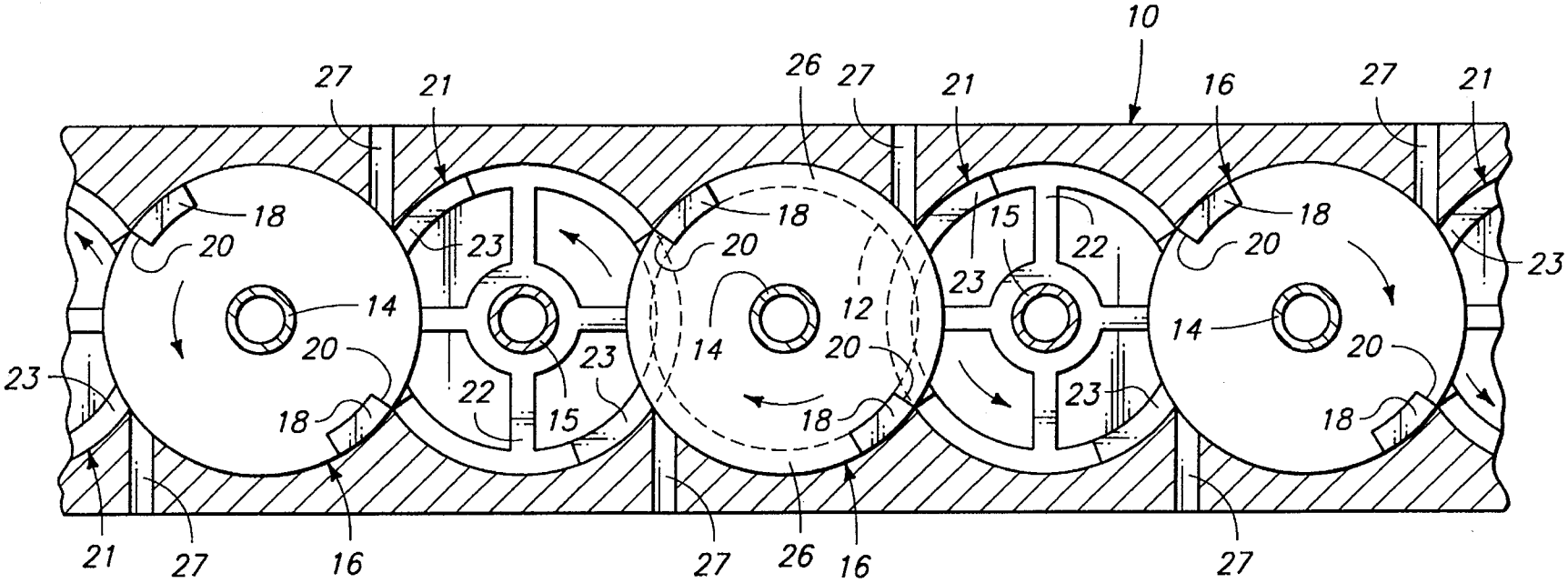
FIG. 3 is a schematic view similar to FIG. 2, illustrating alternate positions of the rotors and valves.

This expanding relationship is specifically illustrated at the center of FIGS. 2 and 3. FIG. 2 illustrates a center angular position wherein each overlapping lobe 18 is free to pass between the gap separating the two flanges 23 on the overlapping rotary gate valves 21. In FIG. 3, an expansion chamber or combustion chamber 26 is formed about groove 12 from the outer peripheral surface of each flange 23 to the rearward wall 20 of the rotating lobes 18 on rotors 16. The combustion chamber is free to expand until the rearward wall 20 of each lobe 18 clears an intersecting exhaust port 27 formed through the engine block 10 in open communication with the groove 12.

As shown diagrammatically in FIG. 6, drive connections are provided between the rotor shafts 14 and gate valve shafts 15 for continuously rotating them in a timed relationship and in opposite rotational directions. The drive connections might be in the form of meshing gears 25. The respective directions of rotation of the rotors 16 and rotary gate valves 21 are shown by arrows included in FIGS. 2 and 3. Idler gears can be included in the controlling gear trains to provide the desired relative directions of motion of the rotors and gate valves.

While the illustrated engine components show use of two lobes spaced diametrically (equiangularly) about the rotor axes R—R at each side of the rotor 16 and two flanges 23 also spaced diametrically (equiangularly) apart about the gate valve axes G—G, it is to be understood that one lobe and flange can be used, and that greater numbers of lobes and flanges can be used if desired.

Using one lobe and one gate valve will lengthen the power stroke substantially and might be preferable if balanced by a similar arrangement at the opposite sides of the rotors and gate valves. If single lobes are used at the sides of the rotor, they and the associated flanges should be offset by 180° to provide greater operational continuity and overlap of their respective power strokes.

Greater numbers of lobes and flanges will correspondingly reduce the power "stroke" or arcuate path along the grooves 12 in which gaseous expansion occurs in the combustion chambers 26, and would require inclusion of additional exhaust ports 27 to remove spent combustion gases at the end of each combustion chamber.

If desired, differing numbers of lobes and flanges might be used on the rotors and gate valves. This would require use of different relative rotational speeds for the respective rotors and gate valves.

In addition to the provision of two rotary gate valves 21 interspersed between rotors 16, the sides 17 of each illustrated rotor 16 is respectively overlapped by two rotary gate valves 21 fixed at axially spaced positions along the gate valve shaft 15. Thus, the operative relationship between each groove 12, flange 23 and lobe 18 is duplicated at both the opposed axial sides and the opposed radial ends of each rotor 16. This provides a compact arrangement of constantly rotating elements that greatly simplifies engine design in the illustrated rotary engine configuration.

The drawings show alternating rotors 16 and rotary gate valves 21 arranged along a series of parallel alternating rotor shafts 14 and gate valve shafts 15. Multiplicity of rotors can also be achieved in an axial direction by stacking a series of rotors 16 and rotary gate valves 21 along the axial length of common supporting rotor shafts 14 and gate valve shafts 15.

The drawings in this application are schematic drawings designed to illustrate the basic structure and functions of the engine. When used as an engine, any suitable starting unit can be utilized to initially rotate the rotors until they are self-driven by engine operation. Suitable seals, bearings, cooling channels and ducts, lubrication ducts and other normal engine components are also needed to complete design of a working engine. However, the provision of such features is well known and understood by those skilled in engine design and it is felt that they need not be detailed herein.

The present engine can be powered internally or externally, and either by combustion or by fluid pressure supplied externally. The engine can be powered by air, steam or any suitable motive fluid. It can be started by supplying air to the grooves 12 from an external source (not shown) or by cranking the rotor shafts 14 by conventional geared starter motor assembly (not shown). Magnetic seals can be used about the rotor 14 and rotary gate valve 21 to more effectively seal the pressurized fluids of the engine from leakage during engine operation.

In operation, it is necessary to supply pressurized fluid into grooves 12 in a timed relationship with respect to the rotation of shafts 14 and 15. Fluid should be provided within groove 12 immediately after the lobes 18 have cleared the outer peripheral path of flanges 23 and the moving flanges 23 have sealed off grooves 12 immediately behind the lobes 18.

Incoming pressurized fluid can be delivered to grooves 12 through the engine block, using a valved duct leading to grooves 12 in a manner analogous to the previously described structure of exhaust port 27. However, it is preferable to supply incoming fluid through the lobes 18 themselves. For this purpose, the rotor shafts 14 are shown as being hollow. Each rotor includes one or more radial ducts 24 leading to discharge openings 28 through the rearward walls 20 of the individual lobes 18 (see FIG. 7). Pressurized gases or fluids can thus be directed through the interior of hollow rotor shaft 14 to the ducts 24 of the rotor 16 that rotates in unison on it.

The pressurized fluid (gaseous or liquid) is discharged through openings 28 in a direction opposite to the rotation of rotor 16. This provides a fluid thrust which itself contributes to the rotational forces imparted to rotor 16. However, primary rotational force is exerted on rotor 16 due to the reaction forces of the fluid on the facing peripheral wall of flange 23 which transversely blocks groove 12 during the "power stroke" of the engine as it is rotating. When using two lobes 18 at a side of rotor 16, the "power stroke" will extend over angular rotor sections of about 80° along the annular groove 12. As each lobe 18 clears the open exhaust port 27, the pressurized gases will be discharged to the exterior of the engine. The power cycle will then be repeated.

Figure 7:
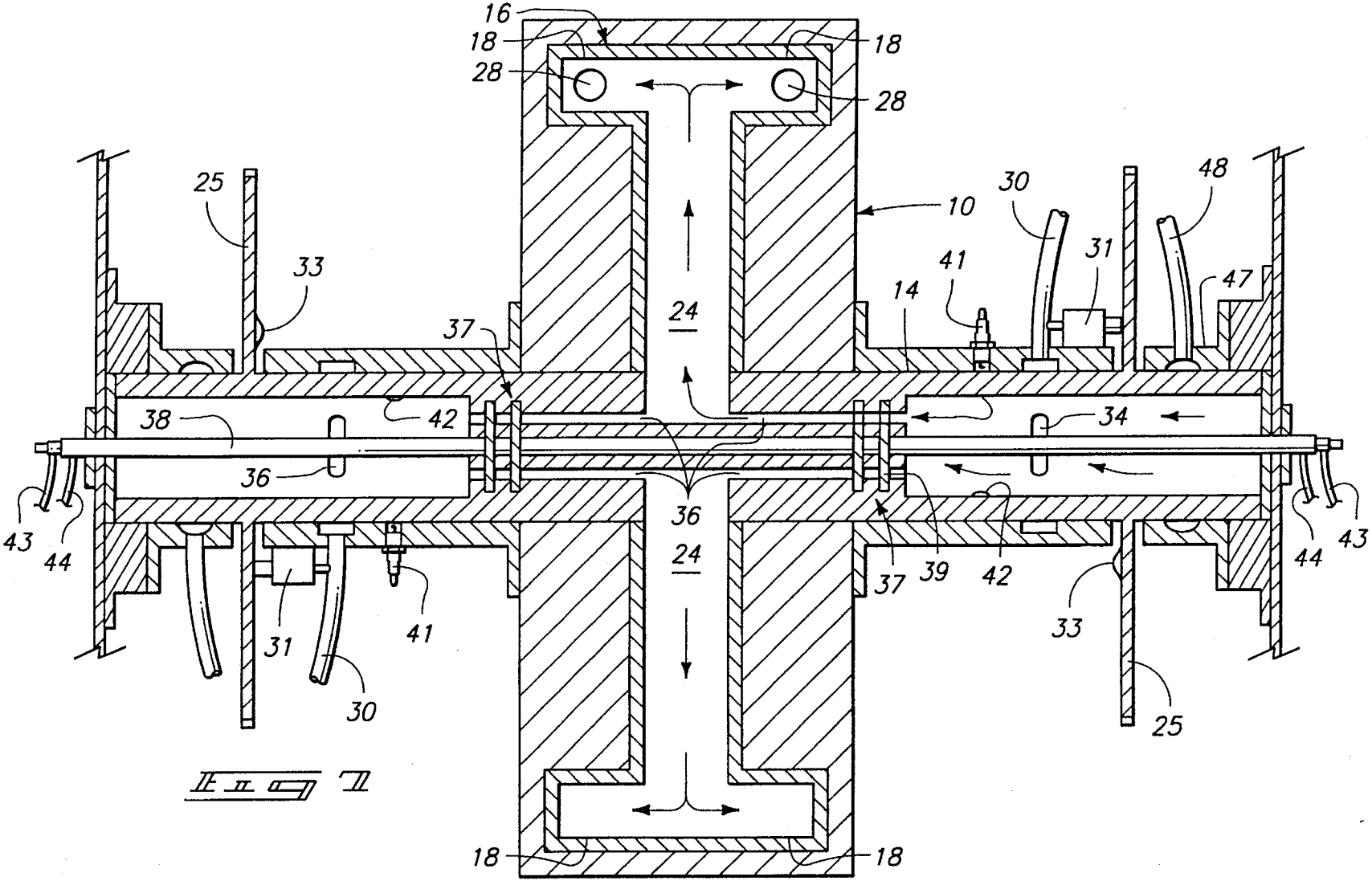
FIG. 7 is an enlarged sectional view through a rotor assembly and taken substantially along line 7—7 in FIG. 6.
Figure 8:
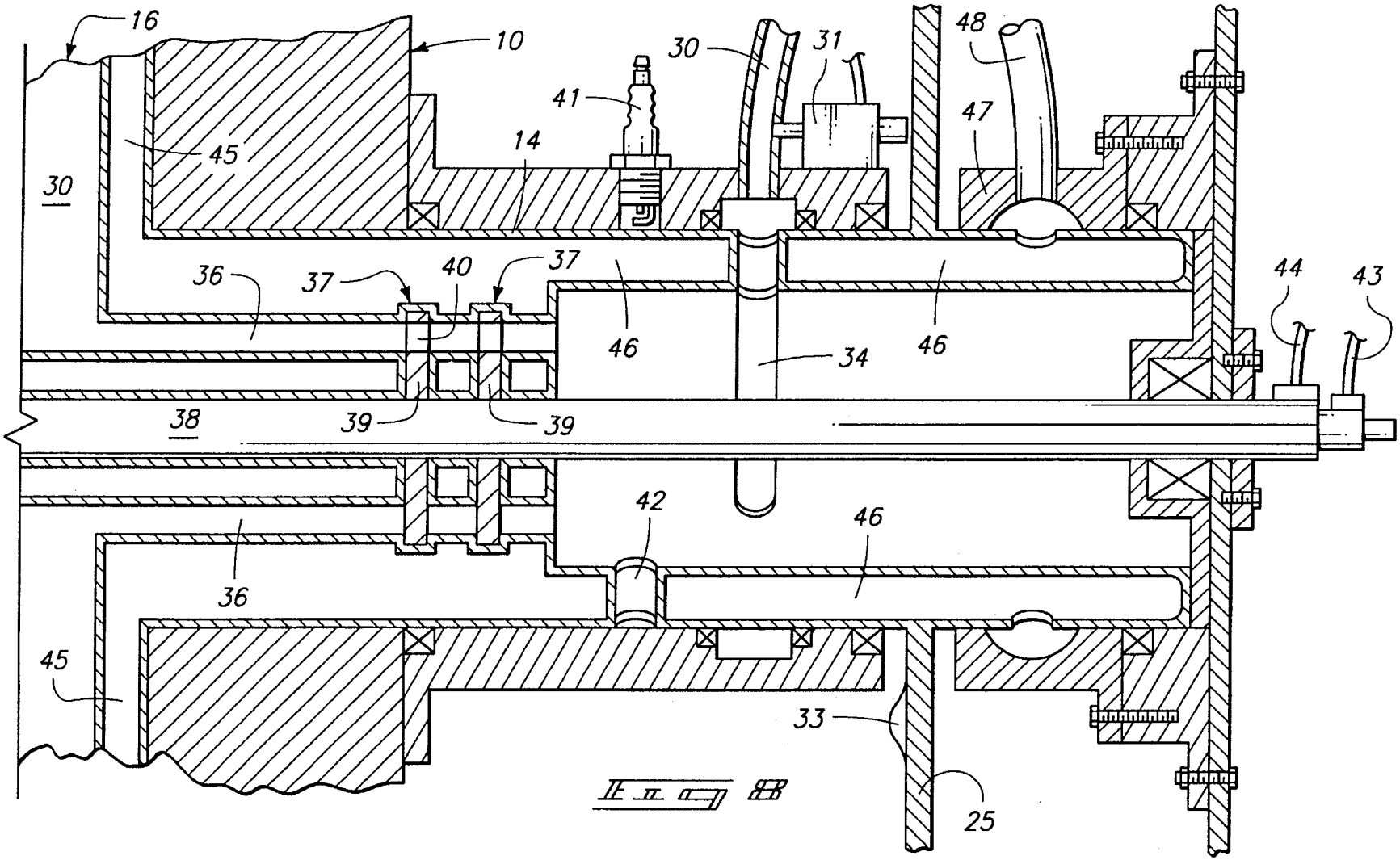
FIG. 8 is an enlarged view of one half of FIG. 7.

FIGS. 7 and 8 show schematic details of equipment for providing pressurized fluid to the engine in an internal combustion cycle of operation. As shown, the hollow rotor shaft 14 is rotatably supported on the engine block or frame 10. The hollow interior of rotor shaft 14 serves as part of an intake manifold formed at one side of the rotor 16 for periodic open communication to a source of incoming gases.

Referring to FIGS. 7 and 8, incoming gases can be supplied through a tube or duct 30. Fuel can be supplied through an interconnecting fuel pump 31 or fuel injector, which might be actuated by an adjacent rotating disk 32 fixed to shaft 14. The previously-described gears 25 might be provided with a protrusion 33 for contact with and timed operation of the fuel pump 31. Alternately, a fuel-gaseous mixture can be supplied through the duct 30 from an external supply source (not shown).

The incoming gases are directed into the rotor shaft 14 through a peripheral slot 34 leading to the shaft interior. The interior of rotor shaft 16 leads to a series of angularly spaced incoming gas supply tubes 36 arranged about the shaft axis. The supply tubes 36 in turn are open to the previously-described incoming gas ducts 24 within rotor 16.

Interposed between the open interior of rotor shaft 14 and supply tubes 36 are a pair of identical rotary intake valves 37. Each rotary intake valve 37 comprises a stationary disk 39 fixed to a shaft 38 centered coaxially within rotor shaft 14. Disk 39 is provided with arcuate openings 40 that are aligned with the incoming gas supply tubes 36 when pressurized gas within rotor shaft 14 is to be in communication with the incoming gas ducts 30. At all other times, the solid portions of disks 39 block passage of gas into the supply tubes 36.

An igniter is shown schematically as a conventional spark plug 41. An opening 42 formed through the hollow rotor shaft 14 is aligned with the spark plug 41 to provide communication with the intake passageway of the hollow rotor shaft 14 when ignition is to occur.

In operation, the slot 34 should precede opening 40 in the intended direction of rotation of the hollow rotor shaft 14. Also, the openings 40 should be aligned with the supply tubes 36 during entrance of gas into the rotor shaft 14. The open communication through rotary intake valve 37 should be maintained through the point of ignition, when rotary intake valve 37 should close due to the rotation of the supply tubes 36 relative to the rotary intake valve 37.

Thus, combustible gases are supplied to the interior of rotor 16 and into the expanding "combustion chamber" formed within groove 12 during engine operation as each flange 23 closes off the operative groove 12. After the gases have been combusted and expanded, they will push lobe 18 and rotor 16 about the rotor axis R—R, until lobe 18 clears the exhaust port 27 leading into groove 12.

The intake manifolds at opposite ends of each rotor shaft 16 can be operated in unison to supply incoming combustible gases to the expanding combustion chamber, or can be operated alternately when higher speed rotor operation is desired.

It is pointed out that the fluid pressurization means shown is exemplary only of a preferred form, and that other internal or external pressurization means may also be employed to the same or equivalent ends as described previously. For example, the ignition of a fuel-air mix could be effected within the expansion chambers by mounting spark or glow plugs in direct communication with the expansion chambers. Injection of a fuel-air mixture could also be made directly into the expansion chambers. However such modifications would eliminate the jetting effect described above and therefore would not be as desirable.

Cooling can also be provided at the interior of shaft 38 through incoming and exit hoses 43 and 44, respectively. Further cooling can be provided by jacketing the rotor 16 as shown by radial ducts 45 and axial ducts 46 in communication with a surrounding coolant jacket 47 and coolant supply tube 48. Coolant can be supplied at one end of a rotor shaft 14 and can exit at its remaining end to provide constant coolant flow through the rotor ducts 45 during operation. Other provisions for coolant within the engine block 10 can also be provided when desired.

It is to be understood that the above description is intended to be rather basic with respect to the essential structure of the engine. Various modifications can be made with regard to the illustrated components without varying their basic structure or operation.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A rotary engine, comprising:

an engine block having a cylindrical rotor bore centered about a transverse rotor axis;

a coaxial open annular groove formed in the rotor bore;

a coaxial rotor shaft mounted within the engine block for rotation about the rotor axis;

a rotor located within the rotor bore and coaxially fixed to the rotor shaft, the rotor including first and second oppositely facing sides along the rotor axis, the rotor further including a lobe protruding axially from one of its sides and having a rearward wall that is transversely complementary to and positioned within the groove for rotational movement along a path centered about the rotor axis;

the engine block further having at least one cylindrical gate valve bore which partially overlaps and interrupts the rotor bore, the gate valve bore being centered about a transverse gate valve axis that is parallel to the rotor axis;

a gate valve shaft mounted within the engine block for rotation about the gate valve axis; and a rotary gate valve located within the gate valve bore and coaxially fixed to the gate valve shaft, the rotary gate valve including first and second oppositely facing sides along the gate valve axis, the rotary gate valve including a flange protruding axially from one side of the rotary gate valve in opposition to the lobe of the rotor;

the rotary gate valve partially overlapping the rotational path of the rotor for rotation of its flange about a circular path that periodically intersects and closes off the groove during each revolution of the rotor and rotary gate valve about their respective axes, thereby defining an engine combustion chamber that extends angularly about the groove from the flange to the rearward wall of the lobe.

2. The rotary engine of claim 1, wherein the axial dimensions of the lobe and flange are substantially identical.

3. The rotary engine of claim 1, further comprising:

a drive connection between the rotor shaft and the gate valve shaft for continuously rotating them in a timed relationship and in opposite rotational directions.

4. The rotary engine of claim 1, further comprising;

an exhaust port formed through the engine block in open communication with the groove.

5. The rotary engine of claim 1, comprising two rotary gate valves respectively overlapping the sides of the rotor.

6. The rotary engine of claim 1, comprising a plurality of rotors mounted within a corresponding plurality of rotor bores in the engine block;

the corresponding sides of each adjacent pair of rotors being overlapped by a common rotary gate valve.

7. The rotary engine of claim 1, wherein the engine block comprises:

at least two gate valve bores centered about parallel transverse gate valve axes at opposite sides of the rotor bore;

at least two gate valve shafts mounted within the engine block for rotation about the respective gate valve axes; and at least two rotary gate valves located within the respective gate valve bores and coaxially fixed to the respective gate valve shafts.

8. The rotary engine of claim 1, comprising at least two lobes spaced equiangularly about the rotor axis at the one side of the rotor and a corresponding number of flanges spaced equiangularly about the gate valve axis at the one side of the rotary gate valve to radially balance operational forces on the rotor and gate valve.

9. The rotary engine of claim 1, comprising at least two lobes spaced equiangularly about the rotor axis at each side of the rotor and a corresponding number of flanges spaced equiangularly about the gate valve axis at oppositely facing sides of the rotary gate valve to both radially and axially balance operational forces on the rotor and gate valve.

10. The rotary engine of claim 1, further comprising:

an intake manifold on the engine block, the intake manifold being formed coaxially within the interior of the rotor shaft at one side of the rotor for periodic open communication to a source of incoming gases;

a supply duct formed within the rotor, the supply duct leading radially between the interior of the rotor shaft and a discharge exit at the rearward wall of the rotor lobe; and a rotary intake valve interposed between the intake manifold and the supply duct for periodically opening communication between them during rotation of the rotor.

11. The rotary engine of claim 1, further comprising:

an intake manifold on the engine block, the intake manifold being formed coaxially within the interior of the rotor shaft at one side of the rotor for periodic open communication to a source of incoming gases;

a supply duct formed within the rotor, the supply duct leading radially between the interior of the rotor shaft and a discharge exit at the rearward wall of the rotor lobe;

a rotary intake valve interposed between the intake manifold and the supply duct for periodically opening communication between them during rotation of the rotor; and an igniter on the engine housing in communication with the intake passageway for selectively causing incoming gases to combust while the intake manifold and intake gas passageway are in open communication through the rotary intake valve.

* * * * *